US005584245A

United States Patent [19]

Schönberg

[11] Patent Number: 5,584,245

[45] Date of Patent: Dec. 17, 1996

[54] WASHER UNIT CONTROL SYSTEM

[75] Inventor: Günter Schönberg, Gablingen, Germany

[73] Assignee: BVS Beratung Verkauf Service Grafische Technik GmbH, Stadtbergen, Germany

[21] Appl. No.: 522,000

[22] Filed: Aug. 31, 1995

[30] Foreign Application Priority Data

Sep. 23, 1994 [DE] Germany ..... 44 34 052.4

[51] Int. Cl.[6] ..... B41F 33/00

[52] U.S. Cl. ..... 101/484; 101/425

[58] Field of Search ..... 101/423, 424, 101/425, 484, 485, 211; 15/256.51, 256.52, 256.53

[56] References Cited

U.S. PATENT DOCUMENTS

| | | | |
|---|---|---|---|
| 4,686,902 | 8/1987 | Allain et al. | 101/425 |
| 4,798,228 | 1/1989 | Gollinger et al. | 101/425 |
| 4,930,415 | 6/1990 | Hara et al. | 101/425 |
| 5,005,478 | 4/1991 | Goldberg et al. | 101/425 |

FOREIGN PATENT DOCUMENTS

| | | | |
|---|---|---|---|
| 0031641 | 2/1989 | Japan | 101/425 |
| 118158 | 5/1991 | Japan | 101/425 |

*Primary Examiner*—Ren Yan

*Attorney, Agent, or Firm*—Edwin D. Schindler

[57] ABSTRACT

In a method and a device for controlling the blanket cylinder washing processes of a rotary offset printing machine with several printing units (d1) each assigned a washer unit (12–27) and several reel changers (33) each connected to a reel changer control unit (34), spoilage is reduced by simple, operator-friendly, cost-effective and universal means when washer units (12–27) are connected to the outputs of a washer unit control (40), a trigger signal (A) is applied at one output of the washer unit control (40) and at the output of a logical AND-function of the reel changer signal (R) and of a counting signal (Z) of a counting device (38) for the printed copies, and a memory is provided for the current data set with distances from the lead reel changer (33) to the first-triggered washer units (22, 23, 24, 25) assigned to the web coming from the lead reel changer, and the respective distances from all washer units (12–27) to the folder, the web speed and the web widths, so that the wash spoilage of all webs occurring during washing and any reel change spoilage arrive simultaneously at the folder.

8 Claims, 3 Drawing Sheets

WASHER UNIT CONTROL SYSTEM

The invention relates to a method and device for controlling the rubber blanket washing operations of an offset rotary printing machines with printing units each having one or more washer units, and several reel changers each supplying a stock web.

BACKGROUND OF THE INVENTION

With the known methods and devices, in connection with each reel change, costly spoilage occurs during washing.

Arising from this situation, the problem of the present invention is to reduce the spoilage by operator-friendly, cost-effective and universal means which are as simple as possible.

BRIEF SUMMARY OF THE INVENTION

According to the present invention there is provided a method of controlling the rubber blanket washing operations of an offset rotary printing machine with several printing units each having one or more washer units, and several reel changers each supplying a stock web; the method comprising:

triggering each reel change by a reel change signal From a reel change controller unit at the reel changer concerned;

triggering the washing process of the washer unit or units assigned to the web coming from the respective reel changer with a reel change signal of a reel changer at times which are phased to coincide with the period of reel change spoilage occurring during the reel change;

triggering the further washer units in phase such that the wash spoilage of all webs occurring during washing arrive simultaneously at the folder.

The method according to the invention makes it possible, in an extremely operator-friendly way, to place the individual wash spoilage so that it comes together at the folder; in addition, the wash spoilage is also laid on the reel change spoilage of one of the webs, so that altogether only the minimum necessary spoilage occurs.

Preferably the time between the reel change at a predeterminable reel changer and the washing process at the assigned washer unit or units first triggered by the web coming from this reel changer is calculated from the quotient of the stored distance from the reel changer to the washer unit and the web speed. Thus, in a very universal and operator-friendly way, the wash spoilage can be placed on the spoilage of the associated lead reel changer, by computerized linkage of the stored distance and the measured:web speed to the period of time needed by the web to get from the reel changer to the associated washer unit, without actual setting of the period of time required.

It is also advantageous if a washer unit from which the web distance to the folder is less than the web distance from the first-triggered washer unit to the folder is triggered after the first-triggered washer unit by a period of time corresponding to the quotient of the difference in web distances from the washer units to the folder, and the web speed. This makes possible precise triggering of this washer unit at the correct point in time before triggering of the so-called first-triggered washer unit assigned to the lead reel changer. Similarly it is expedient if a washer unit from which the web distance to the folder is greater than the web distance from the first-triggered washer unit to the folder is triggered before the first-triggered washer unit by a period of time corresponding to the quotient of the difference in web distances from the washer units to the folder, and the web speed. By this means, the washer units with shorter web distances to the folder than the web distance of the web assigned to the lead reel changer will also be triggered at the correct point in time after the washer unit on the web assigned to the reel changer.

It is especially operator-friendly and efficient if, for any specific production of the rotary offset printing machine, a data set with the distance between the first-triggered washer unit and the reel changer assigned to it, together with the distances from the washer units to the folder and the web widths of the webs, can be selected from several data sets in a memory, from a control console or panel, since the necessary data are thus advantageously made available in a simple and efficient manner.

In order to avoid selection of the reel changer of a web not in use as the lead reel changer, it is advantageous if the selection of a reel changer as lead reel changer is accepted only if this reel changer is in operation.

In order to save cleaning fluid, and to prevent contamination of the web or the machine by unnecessarily applied cleaning fluid, it is expedient if the blanket cylinder is washed in segments over the width which corresponds to the web width applicable.

The invention also provides a device for a rotary offset printing machine with several printing units each with a washer unit and several reel changers each connected to a reel changer control unit; wherein means are provided for connecting the washer units at the outputs of a washer unit control; a trigger signal A is provided and connected at one input of the washer unit control; a logical AND-function of the reel changer signal and a counting signal of a counting device for the copies printed are provided; and means are provided for connecting said trigger signal A to said output of the reel changer signal and said counting signal of said counting device; and a memory is provided for the current data set with the distances from the lead reel changer to the first-triggered washer units assigned to the web coming from the lead reel changer, and the respective distance from all washer units to the folder, the web speed and the web widths.

This device according to the invention makes possible in a simple, economic way the reduction of the total spoilage which occurs. If, preferably to the reel changer-splicing signal line from a reel changer control unit to the assigned reel changer, a reel changer signal branch line decoupled from the former is connected, then the reel changer signal can be branched off to the washer unit control without interference.

It is also advantageous if the washer unit segments can be triggered individually via electronic valves, since this facilitates very precise, rapid and simple control of the washing process.

It is in addition expedient for the counter to have a preset counting cycle of around 30,000 copies, since with normal contamination of the rubber blankets, it is sensible to wash at this interval.

The invention may be used in particular with rotary offset printing machines for newspaper printing.

Further features and advantages of the invention emerge from the additional subsidiary claims and the description of an embodiment with the aid of the drawing.

DETAILED DESCRIPTION OF PREFERRED EMBODIMENT

Figure 1:
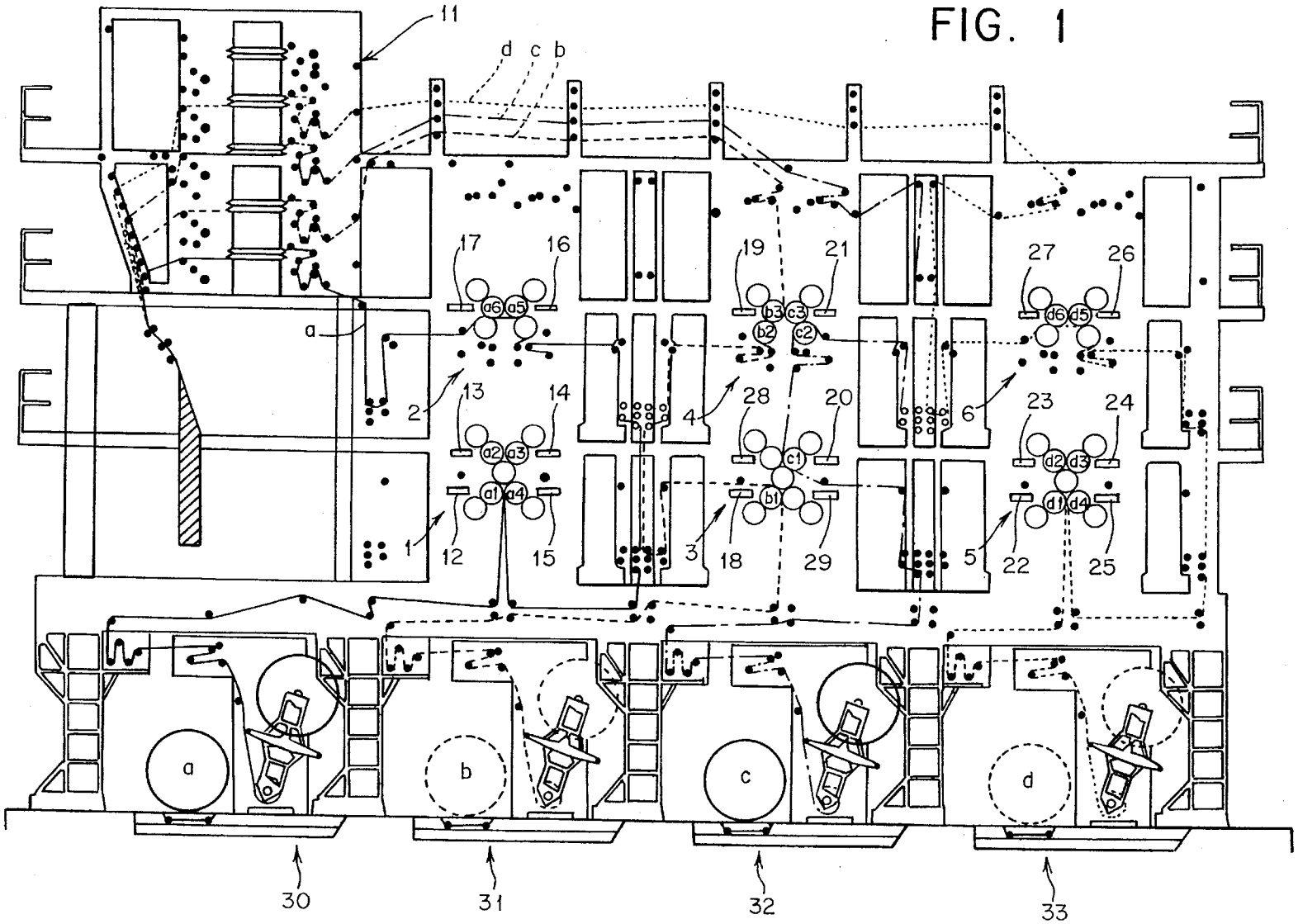
FIG. 1 a schematic side view of a rotary offset printing machine with washer units mounted therein.

FIG. 1 shows a rotary offset printing machine for newspaper printing with several printing units 1, 2, 3, 4, 5, 6, with several stock webs a, b, c, d with various possible widths (e.g. ¼, ½, ¾, 4/4) running from each assigned reel changer 30, 31, 32, 33 along various possible web routes through one or more printing units 1, 2, 3, 4, 5, 6 respectively and finally being processed in the folder 11.

Web a here runs in four-colour printing through printing unit 1, where it is printed via the blanket cylinders a1, a2, a3, a4, then in two-colour printing through printing unit 1, where it is printed via the blanket cylinders a5, a6, and finally to the folder 11. Web b runs through printing unit 2, where it is printed via blanket cylinder b1, then through printing unit 4, where it is printed via blanket cylinder b3. Web c runs through printing unit 3, where it is printed via blanket cylinder cl, then in two-colour printing through printing unit 4, where it is printed via blanket cylinder c3. Web d here runs in four-colour printing through printing unit 5, where it is printed via the blanket cylinders d1, d2, d3, d4, then in two-colour printing through printing unit 6, where it is printed via the blanket cylinders d5, d6. In the course of printing, the blanket cylinders are contaminated by paper deposits, dust and the like.

The blanket cylinders a1, a2, a3, a4, a5, a6, b1, b3, c1, c3, d1, d2, d3, d4, d5, d6 printing in the production shown are therefore washed by the washer units 12, 13, 14, 15, 16, 17, 18, 19, 20, 21, 22, 24, 25, 26, 27 active in this production, each assigned to a blanket cylinder in the sequence given, while the blanket cylinders not printing here should not be washed, so that the washer units assigned to these blanket cylinders, e.g. washer units 28, 29, are inactive.

Cleaning is effected here by spraying on a spray fluid. During cleaning in operation, i.e. with the stock web continuing to run, the spraying of a cleaning fluid on to the blanket cylinders a1, a2, a3, a4, a5, a6, b1, b3, c1, c3, d1, d2, d3, d4, d5, d6 results in wash spoilage on the webs a, b, c, d, the length of which depends on the speed of the web, the amount of cleaning fluid sprayed on, and the duration of the cleaning process. The spoilt areas of the respective webs a, b, c, d define the copies to be separated after the folder 11; a copy must always be eliminated even if only a part of it originates from the wash spoilage area of a web a, b, c or d. Consequently the washing operations of the individual washer units are so placed by the circuitry described below with the aid of FIG. 2, that the wash spoilage of the individual washer units and over and above this also the reel changer spoilage of a reel changer 30, 31, 32 or 33—here a predeterminable lead reel changer 33—coincide, in order to minimise the overall spoilage. Alternatively it would similarly be possible not to use a lead reel changer but instead, after around 30,000 copies had been printed, to trigger the washing operations at the next reel change at one or other reel changer, making allowance for the distance between this reel changer and the associated washer units of the printing unit through which the web assigned to this reel changer will run, while at the same time only one reel changer, which is further removed from the folder than all the washer units, may trigger the washing operations.

The respective web distances Li (i=1–8) from the individual washer units to the folder will subsequently be designated consecutively as $L_{L1}$, $L_2$, $L_3$ etc. and the assigned times $T_i$ as $T_1$, $T_2$, $T_3$ etc.

The web distance relationships and the times assigned via the web speed will now be explained with the aid of FIG. 3. Here the web distances shown in FIG. 3 correspond roughly to the web distances in FIG. 1.

Figure 3:
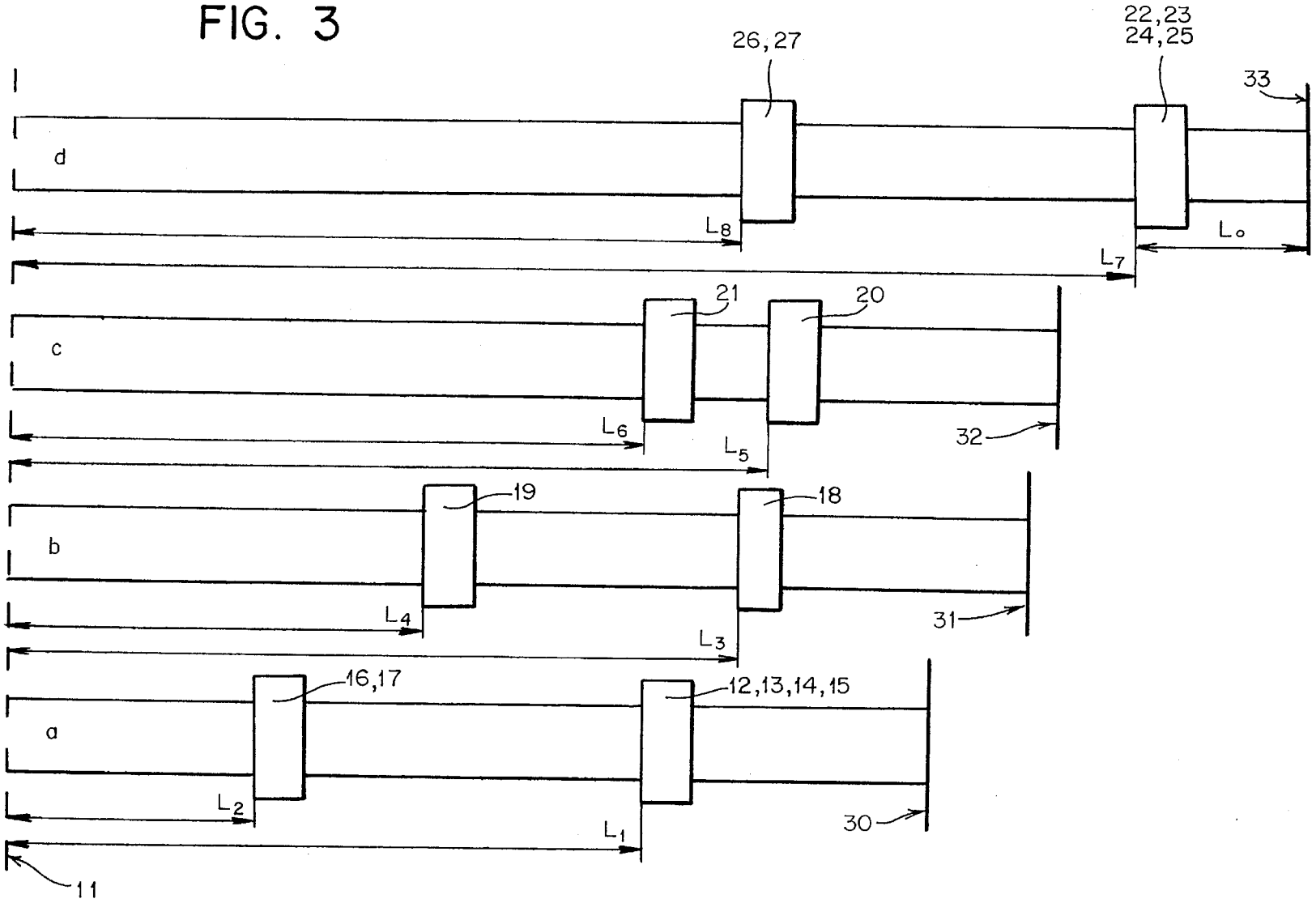
FIG. 3 a schematic representation of the web distances covered in the rotary offset printing machine.

FIG. 3 shows four reel changers 30, 31, 32, 33, from which webs a, b, c, d run through groups of blanket cylinders a1, a2, a3, a4, a5, a6, b1, b3, c1, c3, d1, d2, d3, d4, d5, d6 and the washer units 12–27 respectively assigned to the individual blanket cylinders, to the folder 11.

Thus from reel changer 30, web a runs through a first group of washer units 12, 13, 14, 15 assigned to blanket cylinders a1, a2, a3, a4 (see also FIG. 1), which are triggered simultaneously and are therefore represented by a common rectangular symbol. The other washer units too, which are respectively assigned to the same blanket cylinders printing webs b, c or d and which moreover are located in the same printing unit, are each represented by a common rectangular symbol with the reference character of the corresponding washer units also depicted in FIG. 2. Web a passes after the first group of blanket cylinders a1, a2, a3, a4 with washer units 12, 13, 14, 15, firstly the printing unit 1 printing web a, secondly printing unit 2, the washer units 16, 17 assigned to blanket cylinders a5 and a6, which are both triggered simultaneously and are symbolized in FIG. 3 by the second, i.e. left-hand rectangle with reference numbers 16, 17, located above web a.

Correspondingly web b passes the blanket cylinder b1 of the first printing unit 3 printing it, with the associated washer unit 18, and in the second printing unit 4 it passes the washer unit 19 assigned to blanket cylinder b3.

Web c runs in the first printing unit 3 past washer unit 20 assigned to blanket cylinder c1, and in the second printing unit 4 past washer unit 21 assigned to blanket cylinder c2.

Web d runs in the first printing unit 5 past washer units 22, 23, 24, 27 assigned to blanket cylinders d1, d2, d3, d4, and in the second printing unit 6 past washer units 26, 27.

So that the wash spoilage of all washer units 12–27 and the reel changer spoilage of the lead reel changer 33 assigned to web d arrive simultaneously at the folder 11, allowance must be made for the various web lengths to the folder 11 in such a way that washer units lying closer to the folder 11 are triggered later.

The web distance of web a from the washer units 12, 13, 14, 15 of the first printing unit 1 printing web a, to the folder 11 is L1 the web distance from the washer units 16, 17 of the second printing unit 2 printing web a to the folder 11 is L2.

The web distance of web b from the washer unit 18 of the first printing unit 3 printing web b to the folder 11 is $L_3$; the web distance from the washer unit of the second printing unit 4 printing web b to the folder 11 is $L_4$.

The web distance of web c from the washer unit 20 of the first printing unit 3 printing web c to the folder 11 is $L_5$; the web distance from the washer unit of the second printing unit 4 printing web c to the folder 11 is $L_6$.

The web distance of web d from the washer units 22, 23, 24, 25 of the first printing unit 7 printing web d to the folder 11 is $L_7$; the web distance from the washer units 26, 27 of the second printing unit 8 printing web d to the folder 11 is $L_8$.

Triggering of the washing process is effected after the reel change of the predetermined reel changer 33. In the example illustrated, only reel changer 33 can be the lead reel changer.

The so-called first-triggered washer units 22, 24, 25 are triggered at the time To after the reel change of the lead reel changer 33, wherein $$To=Lo/v$$

with web speed v and web distance Lo from the lead reel changer 33 to the washer units 22, 23, 24, 25.

The washer units 26, 27 of the blanket cylinders d5, d6 assigned to printing unit 6 printing web b are $(L_7-L_8)$ closer to the folder 11, and should therefore be triggered $t=(L_7-L_8)/v$ later than the washer units 22, 23, 24, 25 of the first printing unit 5, and therefore t $tot=T+t=T+(L_7-L_8)/v$ after the reel change of the lead reel changer 33. All other washer units 16 to 21 must also be triggered in accordance with their distance from the folder 11. Thus for example washer units 12, 13, 14, 15 of the first printing unit 1 printing web a are $(L_7-L_1)$ closer to the folder 11 than the latter, and should therefore be triggered t $tot=T+t=T+(L_7-L_1)/v$ later than the reel change of the lead reel changer 33. The time calculation is made similarly for the other washer units.

If e.g. in the case of certain web routes, several webs—here webs b and c—are running through a printing unit—here printing units 3 and 4, then the washer units associated with each web—here 18, 20 and 19, 21 respectively—will be triggered separately from one another.

As may be seen from FIG. 3, only one reel changer 30–33 may be chosen as lead reel changer, which is closer to the folder than all washer units 12–27 of all webs a, b, c, d, since the reel change at the lead reel changer is used as the trigger for the washing operations of all washer units 12–27. In FIG. 3, for example, reel changer 33 is predetermined as the lead reel changer, since it has the longest distance to the folder 11, indicated left in FIG. 3.

The storage, selection and calculation of the time intervals between the individual processes listed above, i.e. between the reel change at the lead reel changer and the triggering of the individual washing operations together with the timed triggering of each of the processes on the basis of the calculated values will now be described with the aid of the block diagram in FIG. 2. To trigger a reel change of the lead reel changer 33, a reel change signal R from the reel changer control unit 34 is given at the lead reel changer 33 for example via the reel changer-splicing signal line 37. This signal is used to trigger the washer unit control system, by optical or alternatively by other decoupling in the decoupling device 36. This signal is then passed on via the reel changer signal branch line The counting device 38 supplies an output signal Z after a predetermined number of counted copies. Here, the counting of copies may be effected by counting the revolutions of a blanket cylinder, etc.; also instead, the printed web length may be measured.

The counting signal Z of the counting device 38 is logically linked to the reel change signal R in the logical AND-function 39, at the output of which the trigger signal A is passed onto the washer unit control 40. The trigger signal A is thus given only when the counting signal Z of the counting device 38 indicates that a predetermined number of copies have been printed since the last washing operation, and that the reel changer signal R indicates a reel change at the lead reel changer.

The trigger signal A is further processed in the washer unit control 40. To explain this, the illustrated embodiment of a washer unit control 40 is divided into an input module 41, a central unit 42 and an output module 43. The input module 41 receives the trigger signal A, which is designed to trigger the washing operations at different points in time.

This signal is further processed by the central unit 42. The central unit 42 calculates on the basis of the production stored in a memory, the points in time at which the washer units should be triggered, and triggers these washing operations at the correct points in time. Triggering is effected via the output module 43 with drivers, triggering the electronic valves 46, 47, 48, 49 so that section by section, corresponding to the actual web width, the segments 50, 51, 52, 53 of the depicted washer unit 22 of the blanket cylinder d1 are activated, as also of every other washer unit 13–27. Since the segments 50, 51, 52, 53 can be triggered independently of one another, it is possible to wash each blanket cylinder a1, a2, a3, a4, a5, a6, b1, b3, c1, c3, d1, d2, d3, d4, d5, d6 on the width of the web a, b, c, d running past it, i.e. on ¼, ½, ¾ or 4/4 of the width, so that no contamination of web or machine can occur due to surplus cleaning fluid applied next to the web.

The central unit comprises a memory holding, for each of the possible web routes and web widths (¼, ½, ¾, 4/4), the web distances $L_1-L_8$ from the washer units to the folder and the distance Lo from the lead reel changer 33 to the associated, first-triggered washer units 22, 23, 24, 25. The memory, which is not illustrated, could however also be accommodated e.g. in the panel 45 or the control console 44. Thus by input of a number giving the current configuration at the control console 44 or panel 45, all time intervals can be determined From the measured or transmitted web speed v, for phased triggering after the trigger signal A of the washer units 12 to 27. The central unit 10 is in the Form of an electronic circuit with processor, memory, timer, etc.

The washer unit control can have the web width data required For calculating the time intervals transmitted to it as a data set via a serial line 54 or 55 From the control console 44 or panel 45. Likewise, in addition, signals or control sequences may be transmitted over these lines, in particular if e.g. the memory for the configurations was accommodated in the control console or panel, so that only the time intervals would need to be transmitted to the washer unit control. The selected data set transmitted at the control console or panel comprises here the distances Lo occurring with the chosen web routes from the lead reel changer 33 to the washer unit (at least one) 22–27 assigned to the web coming From the lead reel changer, and the respective web lengths L1–L8 From the washer units 12–27 to the folder, the preset or measured web speed, and the web widths (¼, ½, ¾, 4/4). The data transmission is depicted here as serial, but may also be parallel, optical via optic fibre, or effected by other means. From this data, here in the washer unit control 40, but alternatively just as well in e.g. the control console 44 or panel 45, the time intervals for phased triggering of the individual washer units may be calculated. At an input device on the panel or control console it is also possible to input the lead reel changer alongside the chosen production, whereupon this data is likewise transmitted to the washer unit control. The data set is transmitted to the control unit as during initialization.

Figure 2:
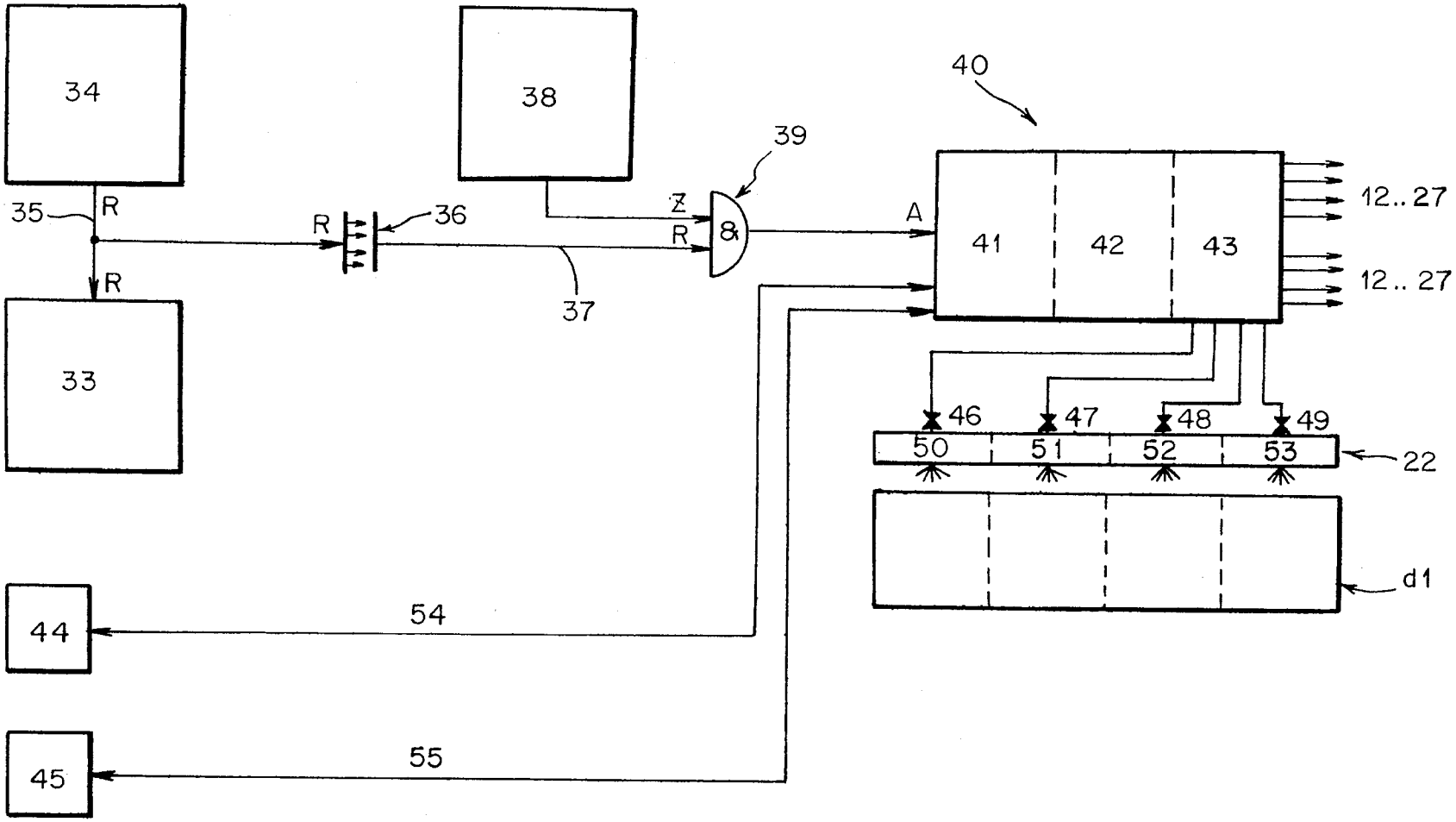
FIG. 2 a block diagram of the circuitry according to the invention.

In FIG. 2 are shown only one washer unit 22 and the associated blanket cylinder d1 with the associated units. The triggering of the other washer units 12–21, 23–27 is only indicated, but is executed in like manner.

I claim:

1. A method for controlling a rubber blanket washing operation of an offset rotary printing machine having a plurality of printing units, each of the printing units having one or more washing units preceding a folder, and a plurality of reel changers with each reel changer supplying a stock web, said method comprising the steps of:

triggering each reel change by a reel change signal from a reel change controller unit to a particular reel changer of said plurality of reel changers;

triggering a washing process of the washer unit of said washer units assigned to the printing unit having a stock web coming from a respective reel changer with the reel change signal of the reel changer at points in time which are phased to coincide with a period of reel change spoilage occurring during the reel change; and, triggering additional washer units, in phase, so that wash and reel change spoilage of all stock webs occurring during washing arrive simultaneously at the folder.

2. The method according to claim 1, wherein a specific washer unit from which the stock web distance to the folder is less than the stock web distance from a first-triggered washer unit to the folder, further comprises the step of triggering said specific washer unit after the first-triggered washer unit by a period of time corresponding to the quotient of the difference in the stock web distances from the washer units to the folder, and web speed.

3. The method according to claim 1, wherein a specific washer unit from which the stock web distance to the folder is greater than the stock web distance from a first-triggered washer unit to the folder, further comprises the step of triggering said specific washer unit before the first-triggered washer unit by a period of time corresponding to the quotient of the difference in the stock web distances from the washer units to the folder, and web speed.

4. The method according to claim 1, further comprising the step of selecting a data set with the distance between the first-triggered washer unit and the reel changer corresponding thereof, together with the distances from said plurality of washer units to the folder and the stock webs width of paper webs, from a plurality of data sets in a memory from a control console or panel.

5. The method according to claim 4, further comprising the step of transferring a current data set with the distance between the first-triggered washer unit and corresponding reel changer thereof, together with the distances from the plurality of washer units to the folder and the stock web widths from a memory in the control console or panel to a washer unit control system during initialization.

6. The method according to claim 1, further comprising the step of selecting a reel changer triggering the washing operation as a lead reel changer before commencing printing.

7. The method according to claim 1, further comprising the step of at least one washing blanket cylinder of the offset rotary printing machine in segments corresponding to the width of the stock web utilized.

8. The method according to claim 1, further comprising the steps of counting a predetermined number of copies of that which is being printed since the most recent washing operation and, upon having printed the predetermined number of copies as counted, providing a trigger signal from the reel change signal for commencing a new washing operation.

* * * * *